US012157045B2

(12) United States Patent
Ellington et al.

(10) Patent No.: US 12,157,045 B2
(45) Date of Patent: Dec. 3, 2024

(54) VIBRATION DAMPING COUPLER FOR A BALL BAT

(71) Applicant: Baden Sports, Inc., Kent, WA (US)

(72) Inventors: Blair J. Ellington, Redmond, WA (US); Grant Farrell Douglas, Seattle, WA (US); Kyle L. Hodge, Seattle, WA (US); Kaitlin Shreffler, Seattle, WA (US); Brent Weidenbach, Seattle, WA (US); Liangzheng Zhou, Anhui (CN)

(73) Assignee: Baden Sports, Inc., Kent, WA (US)

( * ) Notice: Subject to any disclaimer, the term of this patent is extended or adjusted under 35 U.S.C. 154(b) by 423 days.

(21) Appl. No.: 17/576,869

(22) Filed: Jan. 14, 2022

(65) Prior Publication Data

US 2022/0226708 A1 Jul. 21, 2022

Related U.S. Application Data

(60) Provisional application No. 63/138,738, filed on Jan. 18, 2021.

(51) Int. Cl.
*A63B 59/50* (2015.01)
*A63B 102/18* (2015.01)

(52) U.S. Cl.
CPC ..... *A63B 59/50* (2015.10); *A63B 2102/18* (2015.10)

(58) Field of Classification Search
CPC ..... A63B 59/50; A63B 59/51; A63B 59/56; A63B 59/58
See application file for complete search history.

(56) References Cited

U.S. PATENT DOCUMENTS

| | | | |
|---|---|---|---|
| 5,219,164 | A | 6/1993 | Peng |
| 5,593,158 | A | 1/1997 | Filice et al. |
| 6,702,698 | B2 | 3/2004 | Eggiman et al. |
| 6,743,127 | B2 | 6/2004 | Eggiman et al. |
| 6,863,628 | B1 | 3/2005 | Brandt |
| 6,929,573 | B1 | 8/2005 | Chang |
| 6,945,886 | B2 | 9/2005 | Eggiman et al. |
| 7,097,578 | B2 | 8/2006 | Guenther et al. |
| 7,128,670 | B2 | 10/2006 | Souders et al. |
| 7,201,679 | B2 | 4/2007 | Nguyen |
| 7,311,620 | B1 | 12/2007 | Heald et al. |
| 7,410,433 | B2 | 8/2008 | Guenther et al. |
| 7,572,197 | B2 | 8/2009 | Chauvin et al. |
| 7,601,083 | B1 | 10/2009 | Heald et al. |
| 8,226,505 | B2 | 7/2012 | Burger |
| 9,101,810 | B2 | 8/2015 | Carlson et al. |

(Continued)

*Primary Examiner* — Joshua T Kennedy
(74) *Attorney, Agent, or Firm* — Lowe Graham Jones PLLC

(57) ABSTRACT

A ball bat includes a barrel portion and a tapered transition portion. An elastomeric coupler is positioned around a distal portion of a handle. A rigid sleeve is positioned around the elastomeric coupler and the handle is passed through the barrel and transition portion until the distal portion, elastomeric coupler, and rigid sleeve are positioned within the transition portion. The elastomeric coupler may be compressed by the rigid sleeve and may be stretched to be positioned around the distal portion. The distal portion may be flared. Adhesive may be used to secure the distal portion, elastomeric coupler, rigid sleeve, and transition portion to one another. Ridges on the elastomeric coupler may engage grooves in the rigid sleeve to resist rotation.

21 Claims, 11 Drawing Sheets

(56) References Cited

U.S. PATENT DOCUMENTS

| | | | | |
|---|---|---|---|---|
| 9,486,680 | B2 | 11/2016 | Burger et al. | |
| 9,498,690 | B2 | 11/2016 | Carlson et al. | |
| 9,669,277 | B1 * | 6/2017 | Haas | A63B 60/54 |
| 9,814,956 | B2 | 11/2017 | Burger et al. | |
| 10,016,667 | B2 | 7/2018 | Van Nguyen et al. | |
| 10,245,488 | B1 * | 4/2019 | Kays | A63B 60/54 |
| 10,252,127 | B2 | 4/2019 | Van Nguyen et al. | |
| 10,384,106 | B2 | 8/2019 | Hunt et al. | |
| 2007/0191156 | A1 * | 8/2007 | Van Nguyen | A63B 59/50 473/564 |
| 2008/0064538 | A1 | 3/2008 | McNamee et al. | |
| 2009/0280934 | A1 * | 11/2009 | Watari | A63B 59/50 473/566 |
| 2011/0098141 | A1 * | 4/2011 | Burger | A63B 60/08 29/455.1 |
| 2011/0111892 | A1 | 5/2011 | Thouin et al. | |
| 2011/0172038 | A1 * | 7/2011 | Watari | A63B 59/50 473/564 |
| 2016/0184680 | A1 * | 6/2016 | Van Nguyen | A63B 59/54 29/527.1 |
| 2018/0065011 | A1 * | 3/2018 | Earley | A63B 60/42 |
| 2020/0070021 | A1 * | 3/2020 | Gray | A63B 60/54 |
| 2021/0268352 | A1 * | 9/2021 | Montgomery | A63B 60/16 |
| 2023/0233915 | A1 * | 7/2023 | Yamashita | A63B 59/50 473/520 |

* cited by examiner

VIBRATION DAMPING COUPLER FOR A BALL BAT

RELATED APPLICATION

This application claims the benefit of U.S. Provisional Application Ser. No. 63/138,738 filed Jan. 18, 2021 and entitled VIBRATION DAMPENING BAT CONNECTION AND METHODS OF MAKING THE SAME, which is hereby incorporated herein by reference in its entirety.

FIELD OF THE INVENTION

This application relates to ball bats and, more specifically, to structures and methods for connecting a bat barrel to a handle.

BACKGROUND OF THE INVENTION

Many bat manufacturers have endeavored to improve the performance of baseball and softball bats. In the case of a bat, improved performance can come in the form of, among other things, improved swing weight or moment of inertia (MOI), improved accuracy, improved feel, improved barrel length, improved sound, or increased coefficient of restitution or batted ball speed.

Bat manufacturers have attempted to improve the enjoyment of the bat, and to some level the batter's performance, of the batted ball game. This enjoyment can be substantially affected by the "feel", or perception, a batter has with a particular bat. Some of this qualitative "feel" concept is controlled by the management of the vibrational energy transferred, or imparted, to the hands of the user when a ball impacts the barrel of the bat. The concept, also known as shock or "sting", is well known in the art.

Vibration at impact between a bat and ball can generally be reduced by striking the ball within the bat's "sweet spot" or center of percussion. However, a ball struck on either side of the bat's sweet spot (e.g., between the sweet spot and the end cap or between the sweet spot and the handle) may cause vibrations to transmit through the bat and into the user's hands. For example, as shown in FIG. 1A, a bat may have a sweet spot (S). Striking a ball between the sweet spot and the handle (A) can cause a bat to bend or deform as shown in FIG. 1B. Striking a ball between the sweet spot and the cap (B) can cause a bat to bend or deform as shown in FIG. 1C.

The bending or deformation may result in vibrations that may create an unpleasant or painful sensation for the user and/or may injure the user's psyche, which may inhibit the user's performance during use of the bat. The discomfort or pain may be particularly prevalent among children or aged users. Generally, a bat has a first flexural bending mode and a second flexural bending mode. The first mode generally has a natural frequency of approximately 150 Hz to approximately 200 Hz and, generally, has a bending node approximately 6 inches from the knob (i.e., the end of the bat nearest the handle). This typically results in a low amount of vibration at the bending node of the first flexural bending mode (i.e., 6 inches from the knob) but also typically results in a high amount of deflection (i.e., vibration) at the knob, which is where a user's lower hand is typically positioned. The second flexural bending mode generally has a natural frequency of approximately 600 Hz, and generally has a bending node approximately 2 inches from the knob. Thus, while there may be little to no vibration at or near the knob, a high amount of vibration may be felt where a user's upper hand is typically located.

One method to combat these vibrations and improve the "feel" of the bat has been to create separate handle and barrel portions and create what is referred to as a two-piece bat. The two components are then bonded together either through mechanical means and/or through adhesives. However, these types of constructions might still allow vibration to be transferred to the user's hands. Therefore, more effective solutions are required to improve the user's enjoyment of the bat by eliminating or at least substantially damping the high vibrations from impacts.

There have been numerous attempts to improve a batter's enjoyment by controlling the energy transfer to the user's hands. For example, U.S. Pat. Nos. 10,384,106, 10,252,127, 10,245,488, 10,016,667, 9,814,956, 9,669,277, 9,486,680, 9,101,810, 8,226,505, 7,601,083, 7,572,197, 7,410,433, 7,311,620, 7,201,679, 7,128,670, 6,945,886, 6,929,573, 6,863,628, 6,743,127, 6,702,698, 5,593,158, 5,219,164, and U.S. Patent Application Publication Nos. 2008/0064538, 2011/0111892, and 2016/0184680 disclose various attempts to improve the energy control or the shock attenuating features of a bat.

Most conventional bats include only a single vibration isolator such that vibration is reduced for only one of the bending modes. Some bats may use high damping materials to absorb shock. High damping materials may limit the transmission of vibrations at frequencies lower than the natural frequency but may allow more vibration above the natural frequency. Other bats may use low damping materials. Low damping materials may better limit vibration at frequencies above the natural frequency but tend to transmit more vibration at the natural frequency.

An example of a bat design aiming to absorb vibration is U.S. Pat. No. 5,593,158. This bat comprises a single elastomeric isolation union element between a separately manufactured handle and barrel. An elastomer is used to damp vibration but is only capable of damping a single mode.

Yet another bat design aiming to reduce vibration is shown in U.S. Pat. No. 9,669,277 which describes a joint connecting a handle and a barrel. The joint comprises a collar and a spacer that separates the collar from the distal end of the handle. The joint is used to damp vibration but again is only capable of damping a single mode.

It would be an advancement in the art to provide an improved vibration isolator for ball bats.

SUMMARY OF THE INVENTION

In one aspect of the invention, a ball bat includes a barrel portion having a substantially cylindrical outer surface. A transition portion is connected to the barrel portion and is tapered inwardly from the barrel portion. A handle portion has a distal portion positioned within the transition portion. An elastomeric coupler is secured around the distal portion. A rigid sleeve is secured around the elastomeric coupler and is interposed between the transition portion and the elastomeric coupler.

The distal portion may be flared. The elastomeric coupler may have an inner frustoconical surface and an outer frustoconical surface. The elastomeric coupler may further define one or more ridges extending outwardly from the outer frustoconical surface. The rigid sleeve may define a sleeve frustoconical surface and one or more grooves extending outwardly from the sleeve frustoconical surface. The one or more ridges may be positioned within the one or more grooves. In some embodiments, the inner frustoconical surface further defines one or more grooves extending outwardly from the inner frustoconical surface. An adhesive may be positioned between the elastomeric coupler and the distal portion, the adhesive at least partially filling the one or more grooves. The inner frustoconical surface may have a smaller cone angle than the outer frustoconical surface.

In some embodiments, the outer frustoconical surface is a first outer frustoconical surface. The elastomeric coupler may further define a second outer frustoconical surface and a transition extending inwardly from the second outer frustoconical surface to the first outer frustoconical surface. The rigid sleeve may be positioned around the first outer frustoconical surface and have a proximal edge positioned abutting the transition.

In some embodiments, the elastomeric coupler defines an inner surface contacting the distal portion, the distal portion being larger than an undeformed size of the inner surface. The rigid sleeve may define an inner surface sized such that the elastomeric coupler is compressed between the inner surface and the distal portion. The elastomeric coupler may be made of or include a material having a hardness less than 95 Shore A. The transition portion may connect to the handle portion exclusively through the elastomeric coupler. In some embodiments, all connections between the transition portion and the handle portion includes a member having a hardness of less than 95 Shore A. In some embodiments, the rigid sleeve includes or is made of a material that has a higher hardness than the elastomeric coupler. The rigid sleeve 42 may include or be made of a material having a hardness of at least 20 Shore D. In some embodiments, the elastomeric coupler has a hardness between 40 and 95 Shore A and the rigid sleeve has a hardness between 20 and 90 Shore D.

In another aspect of the invention, a method for manufacturing a ball bat includes (a): positioning an elastomeric coupler around a handle portion and sliding the elastomeric coupler from a proximal end of a handle portion to a distal portion of the handle portion such that the elastomeric coupler is stretched outwardly to fit over the distal portion. The method may further include (b): following (a), passing a rigid sleeve from the proximal end of the handle portion to the distal portion such that the rigid sleeve is positioned around the elastomeric coupler and compresses the elastomeric coupler. The method may further include (c): following (b), positioning a barrel and tapered transition portion around the handle portion and sliding the barrel and tapered transition portion to the distal portion such that the rigid sleeve nests within the tapered transition portion with the barrel extending distally of the handle portion. The rigid sleeve has higher hardness than the elastomeric coupler.

In some embodiments, the method includes applying adhesive between the elastomeric coupler and the distal portion and applying adhesive between the rigid sleeve and the tapered transition portion.

The elastomeric coupler may have a hardness of less than 95 Shore A and the rigid sleeve may have a hardness of more than 20 Shore D.

In some embodiments, the elastomeric coupler defines outwardly extending ridges and the rigid sleeve defines grooves extending outwardly from an interior surface of the rigid sleeve. The method may further include inserting the outwardly extending ridges within the grooves.

In some embodiments, following (c) no connection between the tapered transition portion and the handle portion exists that that is not through the elastomeric coupler.

BRIEF DESCRIPTION OF THE DRAWINGS

Preferred and alternative examples of the present invention are described in detail below with reference to the following drawings.

DETAILED DESCRIPTION OF THE PREFERRED EMBODIMENTS

Figure 1A:
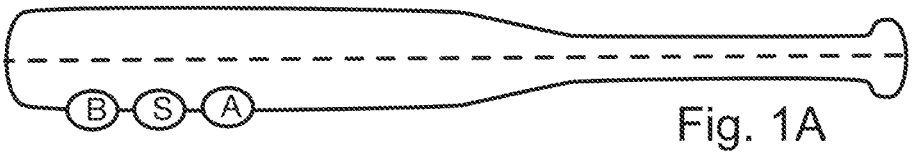
Fig. 1A (Prior Art)
FIGS. 1A to 1C are schematic illustrations showing bending modes of a ball bat.
Figure 1B:
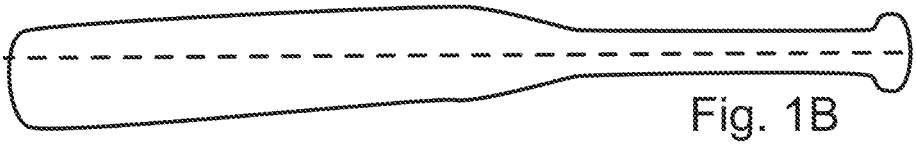
Fig. 1B (Prior Art)
Figure 1C:
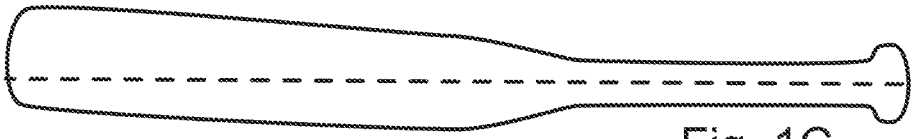
Fig. 1C (Prior Art)
Figure 2:
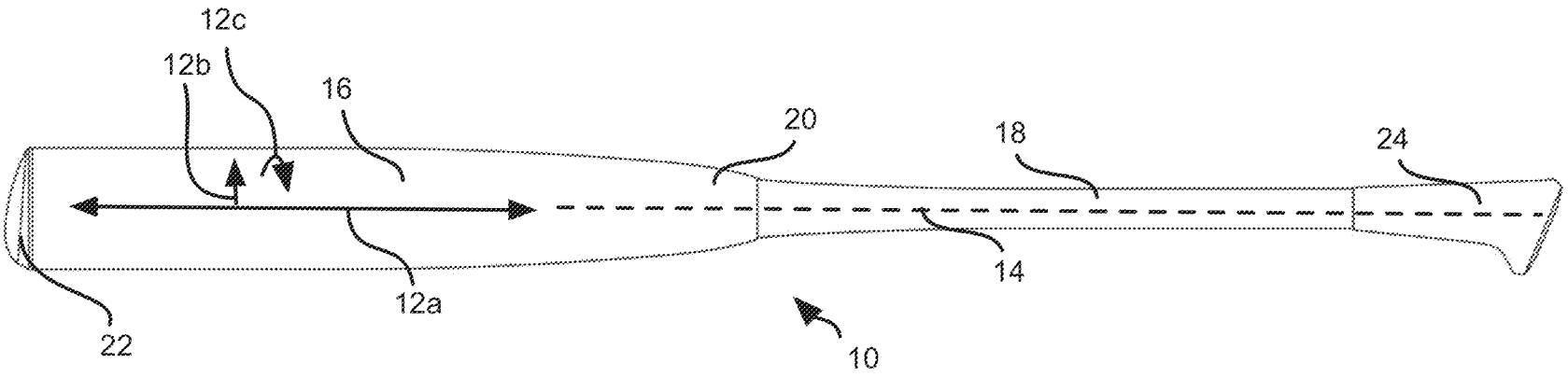
FIG. 2 is a top view of a ball bat in accordance with an embodiment of the present invention.

Referring to FIG. 2, a baseball bat 10 may be understood with respect to a longitudinal direction 12*a* and a radial direction 12*b* defined as an orientation radiating outwardly from the longitudinal direction 12*a* without regard to angle. A circumferential direction 12*c* may be defined as tangential movement or orientation about a center line 14 parallel to the longitudinal direction 12*a* and offset from the longitudinal direction 12*a* along the radial direction 12*b*. In addition, the baseball bat 10 and components thereof may be understood with respect to the terms "proximal end" and "distal end." As used herein "proximal end" shall be understood to refer to an end of the bat or component that is closer to a user's hands when the bat is in use than the distal end. Likewise, "distal end" shall be understood as an end of the bat or component that is farther from the user's hand when the bat is in use than the proximal end.

The baseball bat 10 may include a barrel portion 16, a handle portion 18, and a transition portion 20 (i.e., the taper) between the barrel portion 16 and the handle portion 18. The barrel portion 16 and the handle portion 18 may be cylindrical about the center line 14, an outer diameter of the barrel portion 16 being greater, e.g., between 2 and 4 times greater, than the outer diameter of the handle portion 18. The transition portion 20 may have a frustoconical shape that transitions from the greater diameter of the barrel portion 16 to a smaller diameter. Curved or rounded transitions between the barrel portion 16 and the transition portion 20 and between the handle portion 18 and the transition portion 20 may also be present. The portions 16 and 18 may be substantially cylindrical or include cylindrical and substantially cylindrical portions. For example, "substantially cylindrical" may be understood as a frustoconical shape with a cone angle of between 0 and 3 degrees.

The barrel portion 16 and transition portion 20 may be monolithically formed such as by co-molding, casting, or other approach. The portions 16, 18, 20 may be made of the same material or different materials and each may be any of metal, plastic, composite (e.g., carbon fiber, fiberglass, etc.), wood, or any other material suitable for withstanding the impact forces imposed on a baseball bat when striking a ball. Examples of suitable composite materials include carbon fiber, fiberglass, boron, or aramid (e.g., KEVLAR®) composite. Where a composite is used, fibers may be within a matrix comprising thermoset polymers like epoxy and phenolics, thermoplastic polymers such as low-density polyethylene, high-density polyethylene, polypropylene, nylon, and acrylics.

For example, the barrel portion 16 and transition portion 20 may be made of a metal alloy while the handle 18 is made of another material such as wood, composite, or rigid plastic. In another example, the barrel portion 16 is formed of a combination of a composite material (carbon fiber composite, fiberglass composite) in combination with another material such as an aluminum alloy, titanium alloy, scandium alloy, steel, other alloys, thermoplastic material, thermoset material, wood, or other polymer matrix composite materials.

The barrel portion 16 may be a hollow cylinder of uniform wall thickness and may also have non-uniform thickness or have other non-symmetrical features about the center line 14. The handle portion 18 may be a hollow cylinder of uniform thickness or may also be non-uniform or have non-symmetrical features. In some embodiments, outer surfaces of the barrel portion 16, transition portion 20 and handle portion 18 are symmetrical about the center line 14 but the thicknesses of one or both of the barrel portion 16, transition portion 20, and handle portion 18 vary along the center line 14.

The barrel portion 16 may also include "inserts" designed to alter the performance of batted balls when impacted on the specified striking region of the barrel portion 16. Examples of such inserts can be found in U.S. Pat. No. 9,498,690, which is hereby incorporated herein by reference in its entirety. Such barrel inserts, or any other aspects of the striking region of the bat designed to improve batted ball performance may all be used in conjunction with the invention described herein.

The barrel portion 16 can be sized with a variety of different weights, lengths, and diameters to meet the user's needs. The barrel portion 16 includes a primary tubular ball impact region that is commonly or preferably used for impacting the ball during use. The ball impact region includes the location of the center of percussion ("COP") of the ball bat. The COP is typically identified in accordance with the ASTM Standard F2219. The COP is also known as the center of oscillation or the length of a simple pendulum with the same period as a physical pendulum as a bat oscillating about a pivot. The COP is often used synonymously with the term "sweet spot." The "sweet spot" can include the COP and an area plus or minus 3 inches of the COP along the longitudinal direction 12*a*.

Outer surfaces of some or all of the barrel portion 16, and handle portion 18, and transition portion 20 may be anodized, coated, and/or painted with one or more layers of paint, clear coat, inks, coatings, primers, and/or other outer surface coatings. Outer surfaces of some or all of the barrel portion 16, and handle portion 18, and transition portion 20 may include alpha numeric and/or graphic distinguishing marks indicative of designs, trademarks, graphics, specifications, certifications, instructions, warning, and/or markings. These can include a trademark that is applied as a decal, as a screening, or through other conventional means.

A knob 24 may secure to a proximal end of the handle 18 and an end cap 22 may secure to a distal end of the barrel portion 16. The knob 24 may slide over a proximal end portion of the handle portion 18 and be secured by means of welds, adhesive, rivets, screws, or other fastening means. The knob 24 might be an integral part of the handle. A grip may be attached to the handle portion 18 adjacent the knob 24. The end cap 22 may include a portion that slides within the distal end of the hollow barrel portion 16 and may be secured therein by means of welds, adhesive, rivets, screws, or other fastening means.

Figure 3A:
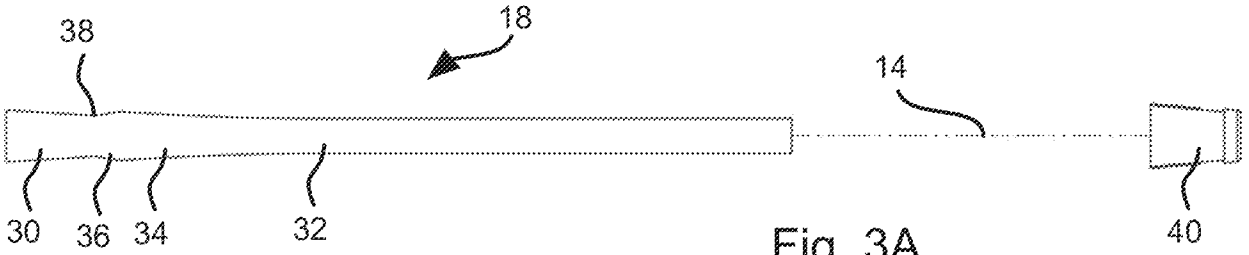
FIGS. 3A to 3D are views illustrating assembly of a ball bat in accordance with an embodiment of the present invention.
Figure 3B:
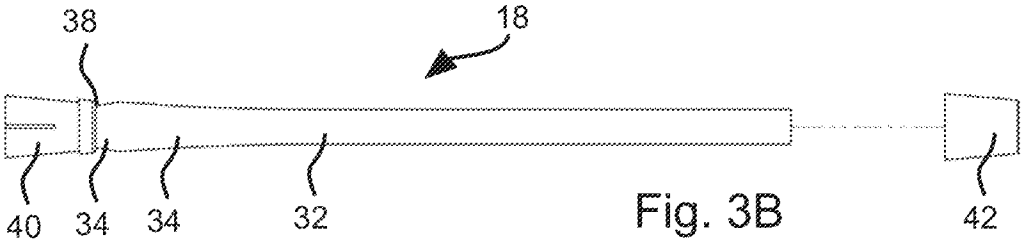
Figure 3C:
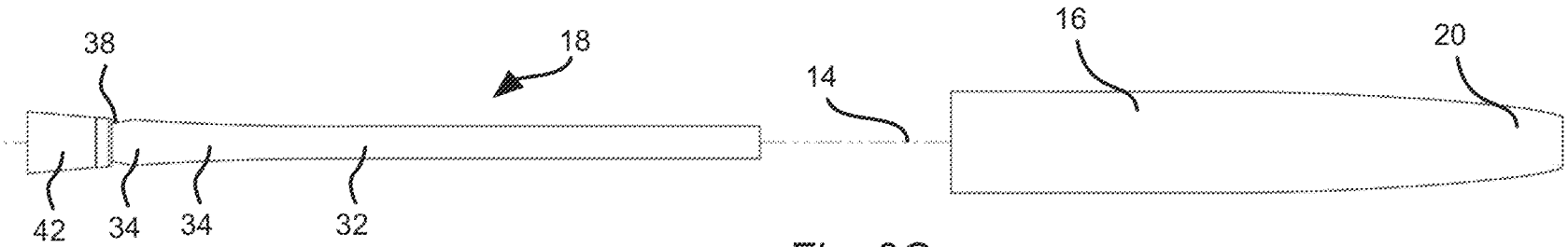

FIGS. 3A to 3C illustrate a method for assembling a bat 10 incorporating improved vibration damping both in terms of degree of vibration damping and ease of manufacture.

Referring specifically to FIGS. 3A and 3B, the handle portion 18 may include a flared distal portion 30. The handle portion 18 may include other non-cylindrical portions. For example, moving from the proximal end to the distal end of the handle portion 18 along the center line 14 there may be a cylindrical portion 32 that is substantially cylindrical, a flared proximal portion 34 that flares outwardly from the cylindrical portion 32, a tapered portion 36 that tapers inwardly, and the flared distal portion 30 that flares outwardly. As is apparent in FIG. 3A, this arrangement may result in a recess 38 between the flared distal portion 30 and the tapered portion 36. The recess 38 may be defined by a rounded transition between the flared distal portion 30 and the tapered portion 36.

The portions 30, 32, 34, 36 may have cone angles between 3 and 15 degrees and may have cone angles that are equal to one another or different form one another. For example, the flared proximal portion 34 may be longer than the flared distal portion 30 and have a smaller flare angle.

During manufacture, an elastomeric coupler 40 is positioned over the flared distal portion 30. The elastomeric coupler 40 may be deformed, i.e., stretched, in order to fit over the flared distal portion 30. A restoring force exerted by the elastomeric coupler 40 on the flared distal portion 30 may increase frictional forces between the elastomeric coupler 40 and the flared distal portion 30.

Positioning the elastomeric coupler 40 may include sliding the elastomeric coupler 40 over the proximal end of the handle portion 18 and sliding the elastomeric coupler 40 along the handle portion 18 until it is over the flared distal portion 30. As shown in FIG. 3B, after positioning, one end of the elastomeric coupler 40 may be in or near the recess 38, such as within 3 mm of the smallest diameter of the handle portion 18 between the flared distal portion 30 and the tapered portion 36. Adhesive may be applied to one or both of the flared distal portion 30 and an interior surface of the elastomeric coupler 40 prior to positioning of the elastomeric coupler on the flared distal portion 30.

The elastomeric coupler 40 may function as a vibration damping member and may be made of a suitable material to form this function. For example, the elastomeric coupler 40 may be made of silicone. Other elastomeric materials may be used. For example, natural or synthetic rubber, styrene-butadiene rubber (SBR), ethylene propylene diene monomer (EPDM), nitrile, flexible plastic, or other elastomeric material may be used. For example, the elastomeric coupler 40 may be made of or include a material having a hardness of between 40 and 95 Shore A may be used. The hardness may be selected to achieve a desired degree of damping.

Referring to FIGS. 3B and 3C, a rigid sleeve 42 may then be positioned over the flared distal portion 30 and the elastomeric coupler 40. Positioning the rigid sleeve 42 may include sliding the rigid sleeve 42 over the proximal end of the handle portion 18 and sliding the rigid sleeve 42 until it is over the flared distal portion 30. The sleeve 42 may be positioned over the elastomeric coupler 40 before or after any adhesive between the elastomeric coupler 40 and flared distal portion 30 has cured. Adhesive may also be applied to the outer surface of the elastomeric coupler 40 and/or an interior surface of the rigid sleeve 42 prior to positioning of the rigid sleeve 42 over the elastomeric coupler 40. Positioning the rigid sleeve 42 over the elastomeric coupler 40 may require deformation (i.e., compression) of the elastomeric coupler 40 and the rigid sleeve 42 may continue to compress the elastomeric coupler 40 once positioned over the elastomeric coupler 40.

The rigid sleeve 42 may be made of a rigid plastic such as polymethyl pentene (also known as TPX), polyamide, acrylonitrile butadiene styrene (ABS), polypropylene, nylon, or other plastic. The rigid sleeve 42 may also be made of a composite material, such as carbon fiber, fiberglass, boron, or aramid (e.g., KEVLAR) composite. Where a composite is used, fibers may be within a matrix comprising thermoset polymers like epoxy and phenolics, thermoplastic polymers such as low-density polyethylene, high-density polyethylene, polypropylene, nylon, and acrylics. The rigid sleeve 42 may be made of metal, such as steel or aluminum. The rigid sleeve 42 may include or be made of a material having a hardness greater than the elastomeric coupler 40. For example, a hardness of 20 to 90 Shore D.

Figure 3D:
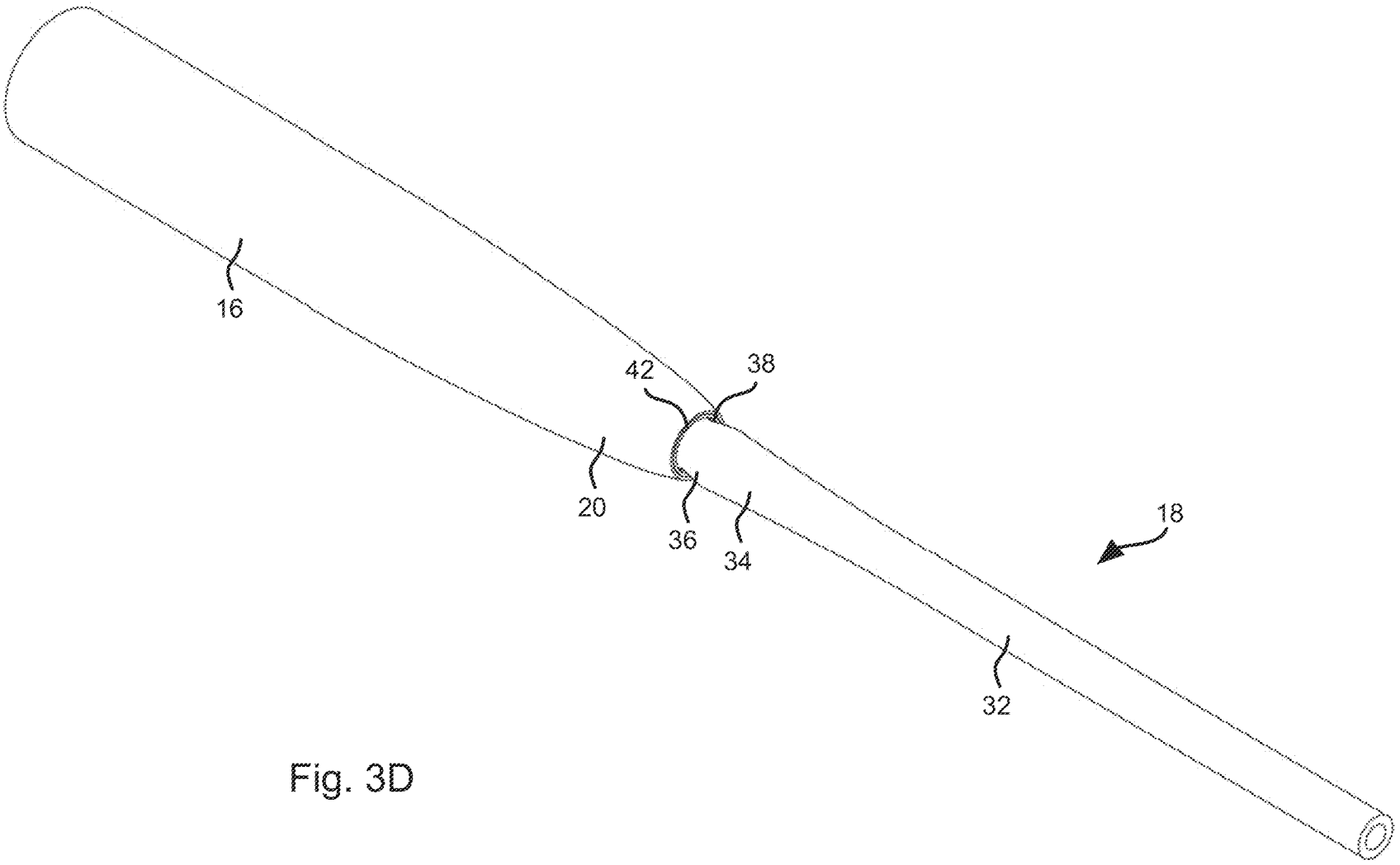

Referring to FIGS. 3C and 3D, the barrel portion 16 and transition portion 20 may then be slid over the proximal end of the handle portion 18 and slid along the handle portion 18 until the flared distal portion 30, elastomeric coupler 40, and rigid sleeve 42 are positioned within the transition portion 20. The transition portion 20 may be positioned over the rigid sleeve 42 before or after any adhesive between the rigid sleeve 42 and the elastomeric coupler 40 has cured. The combined flared distal portion 30, elastomeric coupler 40, and rigid sleeve 42 are flared outwardly with distance from the proximal end of the handle portion 18 and sized such that passage completely through the transition portion 20 is prevented.

The interior surface of the transition portion 20 may have a cone angle and size matching the cone angle and size of the rigid sleeve 42. The rigid sleeve 42 may fit within the transition portion 20 with an interference fit. Alternatively, the rigid sleeve 42 may slide freely into the transition portion 20. In either case, adhesive may be applied to the rigid sleeve 42 and/or the interior surface of the transition portion 20 prior to positioning to fasten the rigid sleeve 42 within the transition portion 20.

After assembling the handle portion 18, barrel portion 16, and transition portion 20 as shown in FIG. 3D, the cap 22 may be secured to the barrel portion 16 and the knob 24 may be secured to the proximal end of the handle portion 18 as shown in FIG. 2. The knob 24 may be according to any knob known in the art. In the illustrated embodiment, the knob 24 is shown as an "axe" type knob. In other embodiments, a round knob 24 may be used.

Figure 4A:
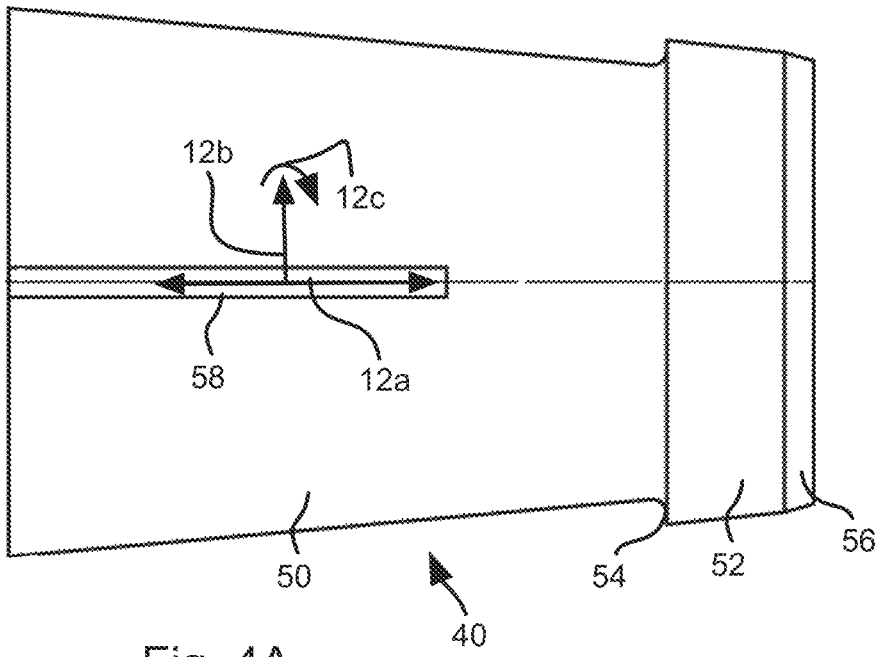
FIG. 4A is a top view of an elastomeric coupler in accordance with an embodiment of the present invention.
Figure 4B:
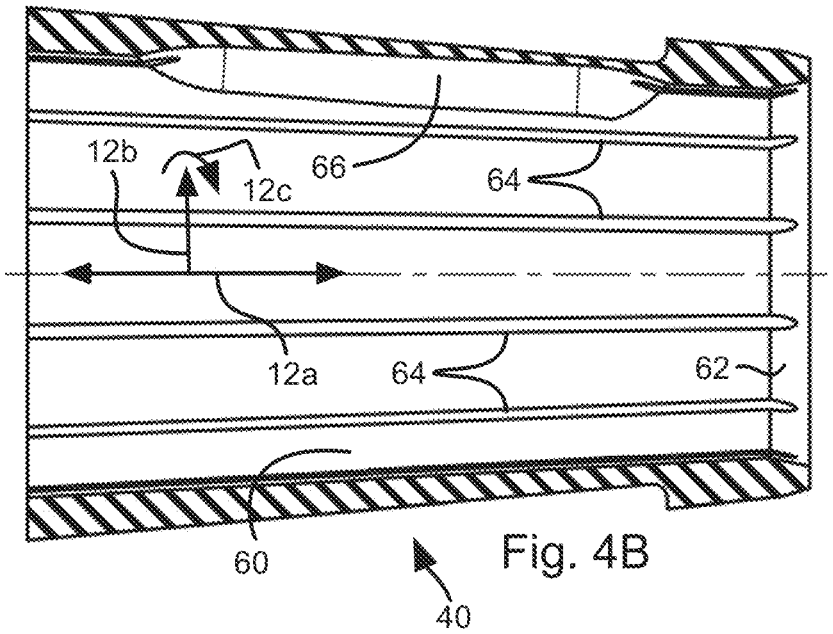
FIG. 4B is a cross-sectional view of the elastomeric coupler of FIG. 4A in accordance with an embodiment of the present invention.
Figure 4C:
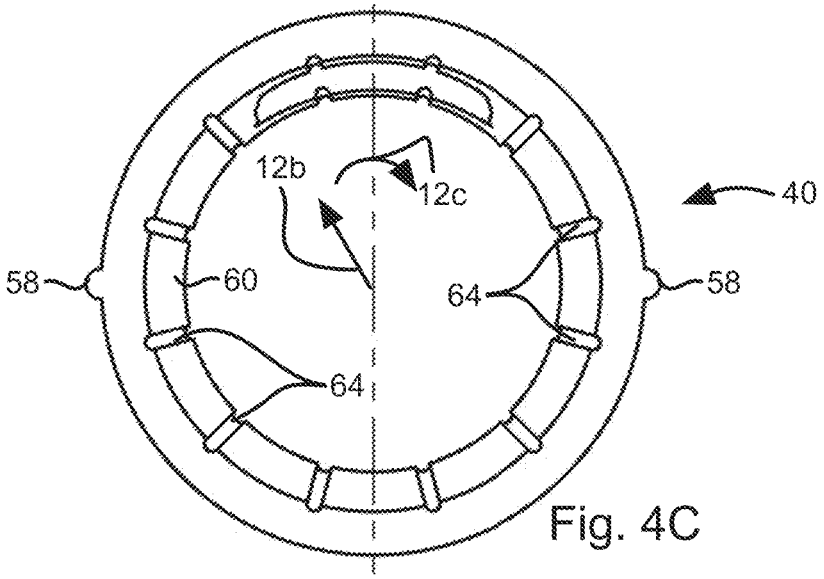
FIG. 4C is a side view of the elastomeric coupler of FIG. 4A.

Referring to FIGS. 4A to 4C, the elastomeric coupler 40 may have a first surface 50 conforming to a frustoconical shape. The outer surface 50 may have a cone angle of between 3 and 15 degrees and may be equal to or different from the cone angle of the flared distal portion 30. In some embodiments, the elastomeric coupler 40 defines a second surface 52 that also has a frustoconical shape that may have the same or a different cone angle as the first surface 50 such that a distal end of the second surface 52 has a greater diameter than the proximal end of the first surface 50. A stepped or curve transition 54 may be defined by the elastomeric coupler between the distal end of the second surface 52 and the proximal end of the first surface 50. In some embodiments, the second surface 52 includes a chamfer or bevel 56 at the proximal end thereof to facilitate insertion into the rigid sleeve 42.

In the illustrated embodiment, ridges 58 are formed on the first surface 50 and extend partially or completely between the proximal end and distal ends of the first surface 50. For example, in the illustrated embodiment, the ridges 58 extend from the distal end partially to the proximal end of the first surface 50, such as between 50 and 75 percent of the distance between the proximal end and distal end of the first surface 50. In the illustrated embodiment, there are two ridges 58 positioned opposite one another. In other embodiments, a single ridge 58 or three or more ridges 58 may be used. As shown in FIG. 4C, the ridges 58 may have a semi-circular cross-sectional shape in a plane parallel to the radial direction 12*b* and perpendicular to the longitudinal direction 12*a*, though other shapes may also be used. In the illustrated embodiment, the ridges 58 are oriented parallel to the axis of symmetry of the frustoconical shape defined by the first surface 50 (e.g., in a plane parallel to the longitudinal direction 12*a* and center line 14). As discussed in greater detail below, the ridges 58 may engage corresponding grooves in the rigid sleeve 42 to resist rotation of the elastomeric coupler 40 relative to the rigid sleeve 42.

An inner surface 60 of the elastomeric coupler 40 may also conform to a frustoconical shape. The inner surface 60 may have the same or different cone angle as the first surface 50. For example, in the illustrated embodiment, the inner surface 60 has a smaller cone angle than the first surface 50 such that the thickness of the elastomeric coupler 40 at the distal end of the first surface 50 is greater than the thickness of the elastomeric coupler 40 at the proximal end of the first surface 50 (thickness being defined herein as being thickness parallel to the radial direction 12*b*). However, in other embodiments, the elastomeric coupler has substantially constant (e.g., within 0.5 mm) thickness between the distal and proximal ends of the first surface 50.

The inner surface 60 may extend along the longitudinal direction 12*a* overlapping both the first and second surfaces 50, 52. The proximal end of the elastomeric coupler 40 may further include an interior chamfer or bevel 62 to facilitate insertion of the flared distal portion 30 into the elastomeric coupler 40.

Grooves 64 may extend outwardly from the inner surface 60 and extend parallel to the longitudinal direction 12*a* partially or completely between the distal end and proximal end of the inner surface 60. The grooves 64 may be partially or completely filled with adhesive used to secure the elastomeric coupler 40 to the flared distal portion 30 thereby increasing the amount of area engaged with the adhesive and providing mechanical interference to resist rotation of the elastomeric coupler 40 relative to the flared distal portion 30.

In the illustrated embodiment, the grooves 64 are distributed substantially (e.g., within 2 degrees of) uniformly about the axis of symmetry of the inner surface 60, such as every 20 degrees, 30 degrees, or some other angular separation. The depth of the grooves may be between 0.1 and 0.5 times the minimum thickness of the elastomeric coupler 40 (e.g., at the proximal end of the first surface 50). The width of the grooves may be such that the each groove occupies an arc of between 2 and 10 degrees along the circumferential direction 12*c*.

In some embodiments, the flared distal portion 30 (FIGS. 3A, 6A) has one or more asymmetric features formed thereon either to resist rotation of the elastomeric coupler 40 or to provide asymmetric properties to the completed bat 10. Accordingly, the elastomeric coupler 40 may further define one or more asymmetric cavities 66 that extend outwardly from the frustoconical shape defined by the inner surface 60. For example, in the illustrated embodiment, the cavity 66 conforms to a portion of an ovoid or ellipsoid shape.

Figure 5A:
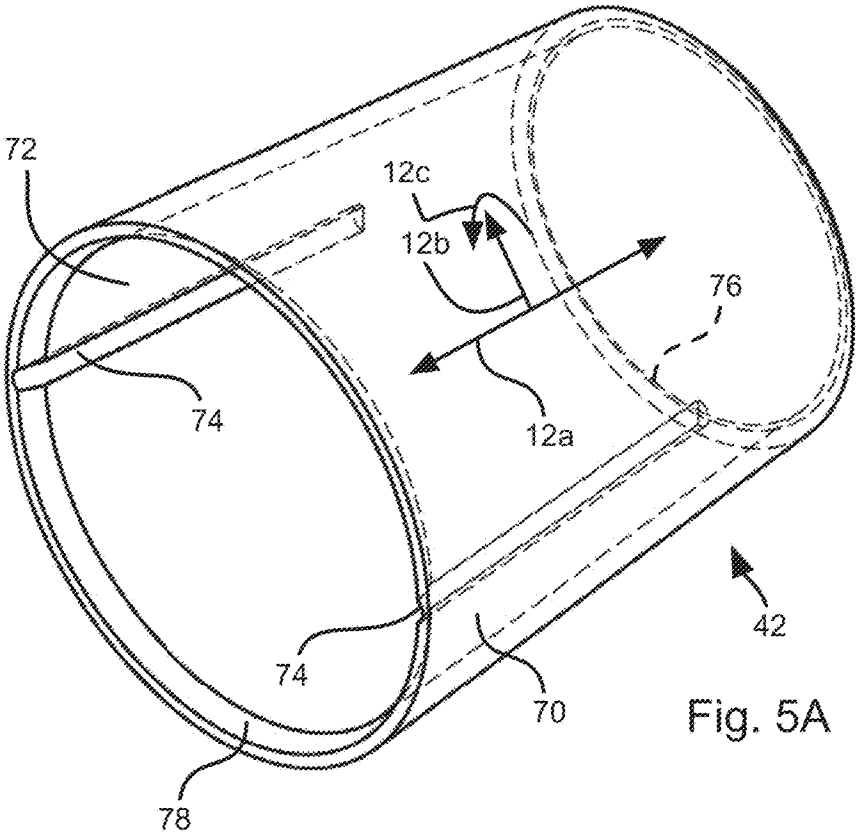
FIG. 5A is an isometric view of a rigid sleeve in accordance with an embodiment of the present invention.
Figure 5B:
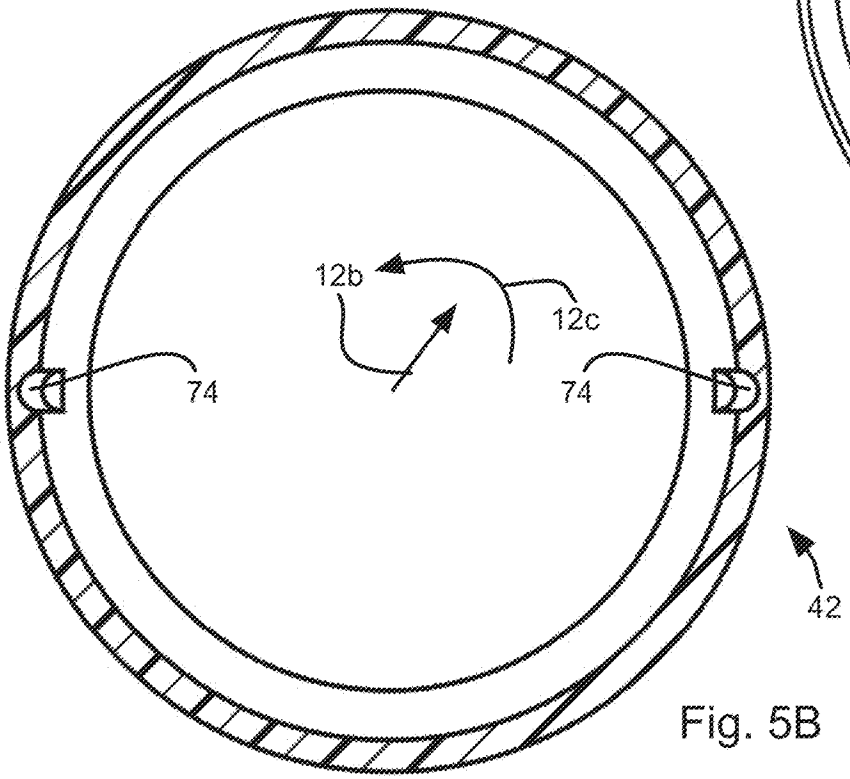
FIG. 5B is a cross-sectional view of the rigid sleeve of FIG. 5A.

FIGS. 5A and 5B illustrate an example configuration of the rigid sleeve 42. The rigid sleeve 42 may include an outer surface 70 conforming to a frustoconical shape. The outer surface 70 may be sized to conform to the interior surface of the transition portion 20. The rigid sleeve 42 may further include an inner surface 72 conforming to a frustoconical shape. The inner surface 72 may have the same or different cone angle as the outer surface 70 such that the thickness of the rigid sleeve 42 is either substantially (e.g., within 0.5 mm) constant or varying along the longitudinal direction 12*a*.

The inner surface 72 engages the first surface 50 of the elastomeric coupler 40. As noted above, when the elastomeric coupler 40 is positioned over the flared distal portion 30, the rigid sleeve 42 may compress the elastomeric coupler 40 against the flared distal portion. Accordingly, upon assembly, each point on the inner surface 72 along the longitudinal direction 12*a* may have a smaller diameter than the undeformed diameter of the first surface 50 of the elastomeric coupler 40 at that point along the longitudinal direction 12*a*.

In the illustrated embodiment, grooves 74 extend outwardly from the inner surface 72 of sleeve 42 and extend partially or completely between the proximal end and distal ends of the inner surface 72. For example, in the illustrated embodiment, the grooves 74 extend from the distal end partially to the proximal end of the inner surface 72. In the illustrated embodiment, there are two grooves 74 positioned opposite one another. In other embodiments, a single groove 74 or three or more grooves 84 may be used. As shown in FIG. 5B, the grooves 74 may have a semi-circular cross-sectional shape in a plane parallel to the radial direction 12*b* and perpendicular to the longitudinal direction 12*a*, though other shapes may also be used. The diameter of the semi-circular shape may be the same as or greater than the diameter of the semi-circular shape of the ridges 58 to provide a gap for receiving adhesive. Alternatively, the diameter of the semi-circular shape may be the smaller than the diameter of the semi-circular shape of the ridges 58 such that deformation (such as compression) of the ridges 58 is required for the ridges 58 to insert within the grooves 74.

In the illustrated embodiment, the grooves 74 are oriented parallel to the axis of symmetry of the frustoconical shape defined by the inner surface 72 (e.g., in a plane parallel to the longitudinal direction 12*a* and center line 14). As discussed above, the grooves 74 may engage corresponding ridges 58 on the elastomeric coupler 40 to resist rotation of the elastomeric coupler 40 relative to the rigid sleeve 42. Note that the placement of the ridges 58 and grooves 74 may be reversed, with grooves 74 being defined on the elastomeric coupler and ridges 58 protruding inwardly from the inner surface 72 of the rigid sleeve 42.

In some embodiments, a chamfer or bevel 76 extends between the inner surface 72 and the proximal end of the rigid sleeve 42. In some embodiments, a chamfer or bevel 78 extends between the inner surface 72 and the distal end of the rigid sleeve 42. The chamfer or bevel 76 may avoid a sharp contact point between the rigid sleeve 42 and the elastomeric coupler 40. The chamfer or bevel 76 may seat within the transition 54 between the first surface 50 and the second surface 52 of the elastomeric coupler 40. The chamfer or bevel 78 may facilitate sliding the rigid sleeve 42 over the elastomeric coupler 40.

Figure 6A:
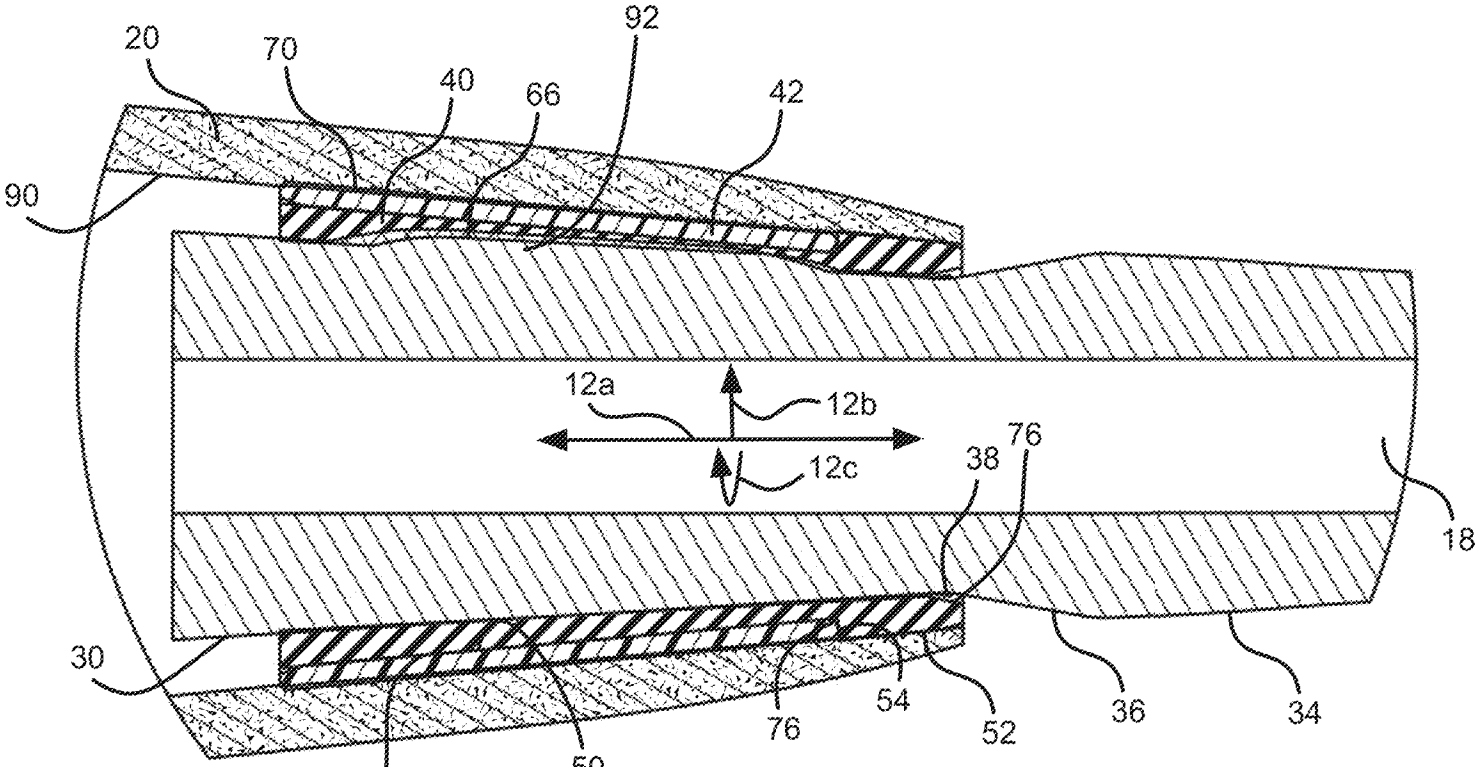
FIG. 6A is a cross-sectional view of a ball bat incorporating the rigid sleeve and elastomeric coupler in accordance with an embodiment of the present invention.

FIG. 6A illustrates the assembled handle portion 18, transition portion 20, elastomeric coupler 40, and rigid sleeve 42. When assembled the rigid sleeve 42 is positioned around the elastomeric coupler and the proximal end of the rigid sleeve is positioned at the transition 54 between the first surface 50 and the larger diameter second surface 52. The transition 54 therefore resists sliding of the rigid sleeve 42 off the elastomeric coupler 40. The thicker region between the second surface 52 and inner surface 60 further provides a greater amount of damping material to absorb energy from relative rotation of the transition portion 20 relative to the handle portion 18.

As noted above, the inner surface 72 of the rigid sleeve 42 is sized such that the elastomeric coupler is compressed thereby when assembled. As also noted above, the thickness of the elastomeric coupler 40 along the first surface 50 increases with distance from the proximal end of the first surface 50. In some embodiments, the amount of compression varies along the length of the first surface 50. In particular, the amount of compression may be greater at the distal end of the surface 50 than at the proximal end. In this manner, the elastomeric coupler 40 functions as a wedge that increases friction between the rigid sleeve 42 and the elastomeric coupler 40 when assembled, thereby resisting collapse of the handle portion 18 into the transition portion 20.

As shown, the transition portion 20 defines a frustoconical interior surface 90. The interior surface 90 engages the outer surface 70 of the rigid sleeve 42 either with or without deformation of the rigid sleeve 42. The undeformed second surface 52 may be larger than the portion of the surface 90 within which it is engaged such that the elastomeric coupler 40 is compressed between the flared distal portion 30 and the surface 90 in the region of the second surface 52.

Adhesive may be positioned between interior surface 90 and one or both of the surface 70 of the rigid sleeve 42 and the second surface 52 of the elastomeric coupler 40. The adhesive may resist collapse of the bat by the handle 18 being forced into the transition portion 20. The flared shape of the rigid sleeve 42 resists removal of the rigid sleeve 42 upon swinging of the bat 10 along with any adhesive used.

As noted above, the handle portion 18 may have asymmetric features formed thereon, such as the asymmetric bulge 92. The asymmetric bulge 92 may seat within the cavity 66 of the elastomeric coupler 40 after assembly. In other embodiments, the asymmetric bulge 92 and cavity 66 are omitted.

As shown in FIG. 6A, the proximal bevel or chamfer 76 is positioned near (e.g., within 3 mm of) the recess 38. This may function as a rocker or pivot point for the transition portion 20 relative to the handle portion 18.

The illustrated approach for incorporating an elastomeric coupler into a bat 10 may provide various advantages relative to prior approaches. The elastomeric coupler 40 is not adhered directly to the transition portion 20 when the rigid sleeve 42 is put in place. The relatively soft elastomer of the elastomeric coupler 40 is difficult to fasten with adhesive. In the illustrated embodiment, the elastomeric coupler 40 secures to the rigid sleeve 42 and the rigid sleeve 42 is secured to the transition portion 20. The elastomeric coupler 40 may secure to the rigid sleeve 42 with an interference fit and may have ridges 58 engaging corresponding grooves 74 on the rigid sleeve 42, which individually or in combination provide a connection that is less susceptible to sliding along the longitudinal direction 12*a* and rotation in the circumferential direction 12*c*.

The rigid sleeve 42 in combination with the transition portion 20 increases the stiffness of the joint between the transition portion 20 and the handle 18. The compression of the elastomeric coupler 40 by the rigid sleeve 42 increases the internal pressure acting on the transition portion 20, which further increases stiffness of the joint. This alters the natural frequency of the bat 10 and reduces the vibrations felt by the user. The stiffness of the joint raises the natural frequency of the bat to higher frequencies and the elastomeric coupler 40 increases damping at low frequencies, both of which decrease the amount of vibration and shock felt by the user in response to impacts outside the sweet spot.

In addition, the handle 18 is completely isolated from the transition portion by the elastomeric coupler 40. Stated differently, there is no connection between the transition portion 20 and the handle portion 18 that does not pass through material within the hardness range defined above for the material of the elastomeric coupler 40. The material of the elastomeric coupler is interposed between the handle portion 18 and both of the rigid sleeve 42 and transition portion 20. The elastomeric coupler 40 is therefore effective at reducing the vibration or shock felt by a player, particularly for impacts outside the sweet spot.

Figure 6B:
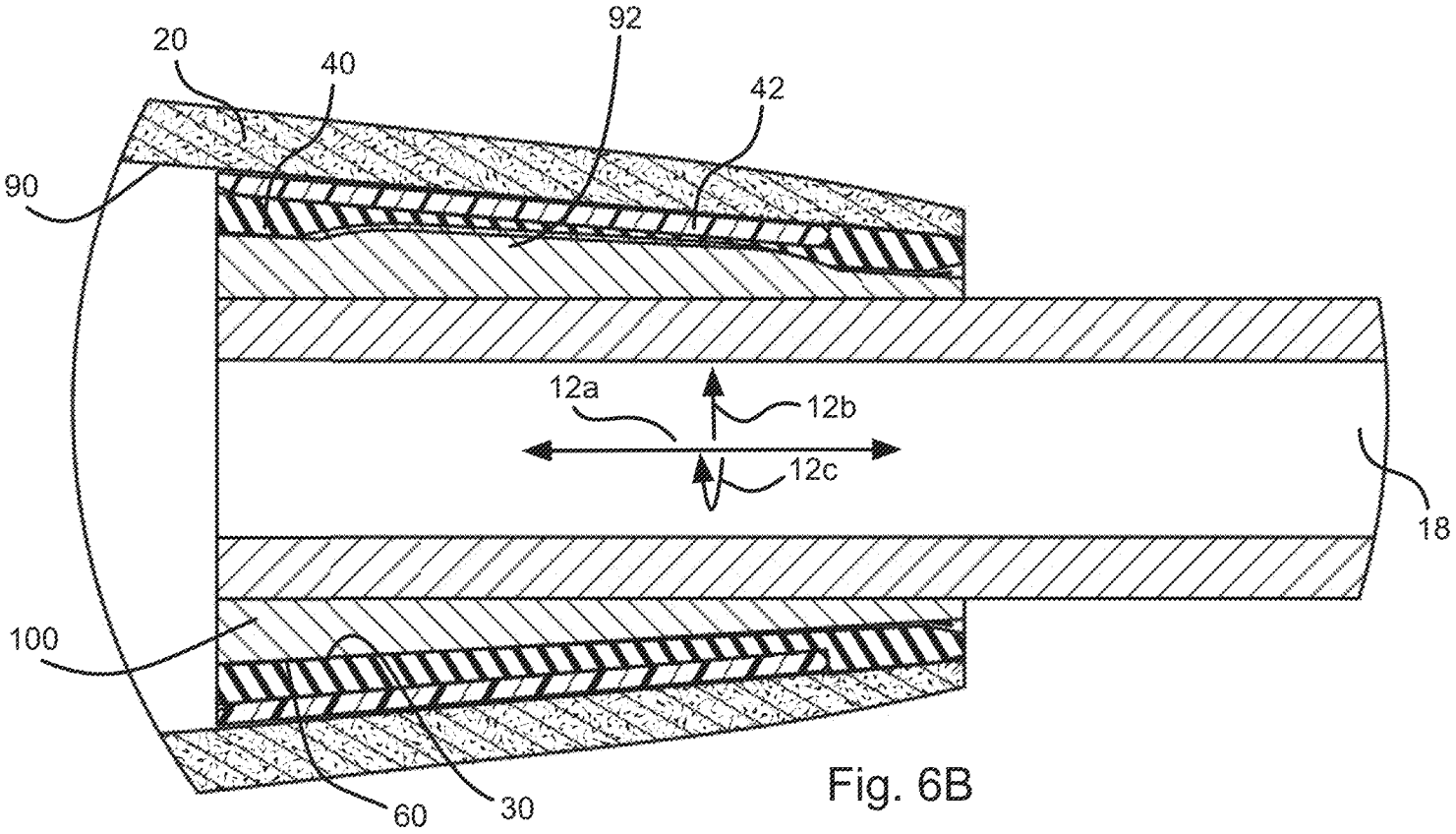
FIG. 6B is a cross-sectional view of a ball bat incorporating the rigid sleeve and a second embodiment of the elastomeric coupler in accordance with an embodiment of the present invention.
Figure 6C:
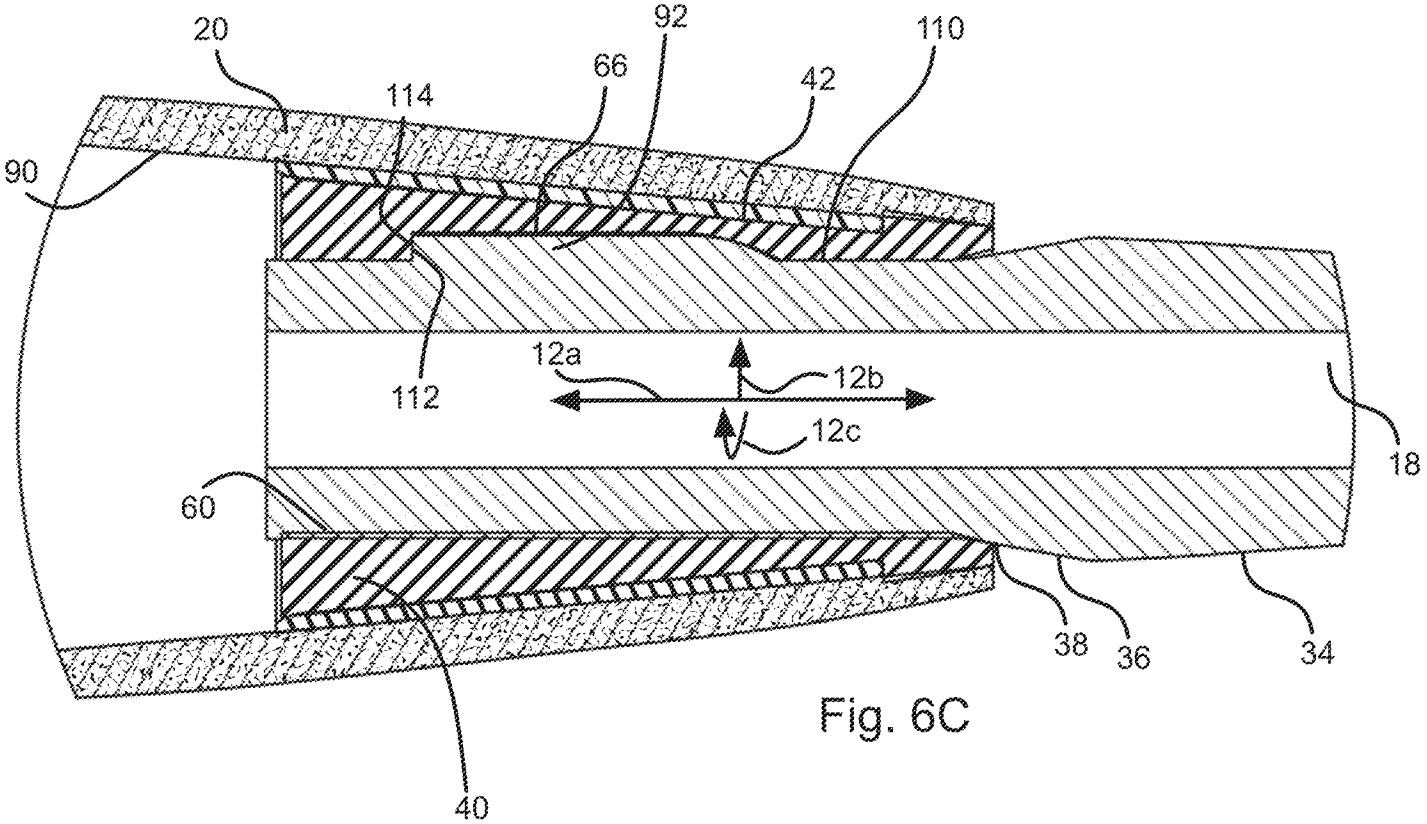
FIG. 6C is a cross-sectional view of a ball bat incorporating the rigid sleeve and a third embodiment of the elastomeric coupler in accordance with an embodiment of the present invention.
Figure 6D:
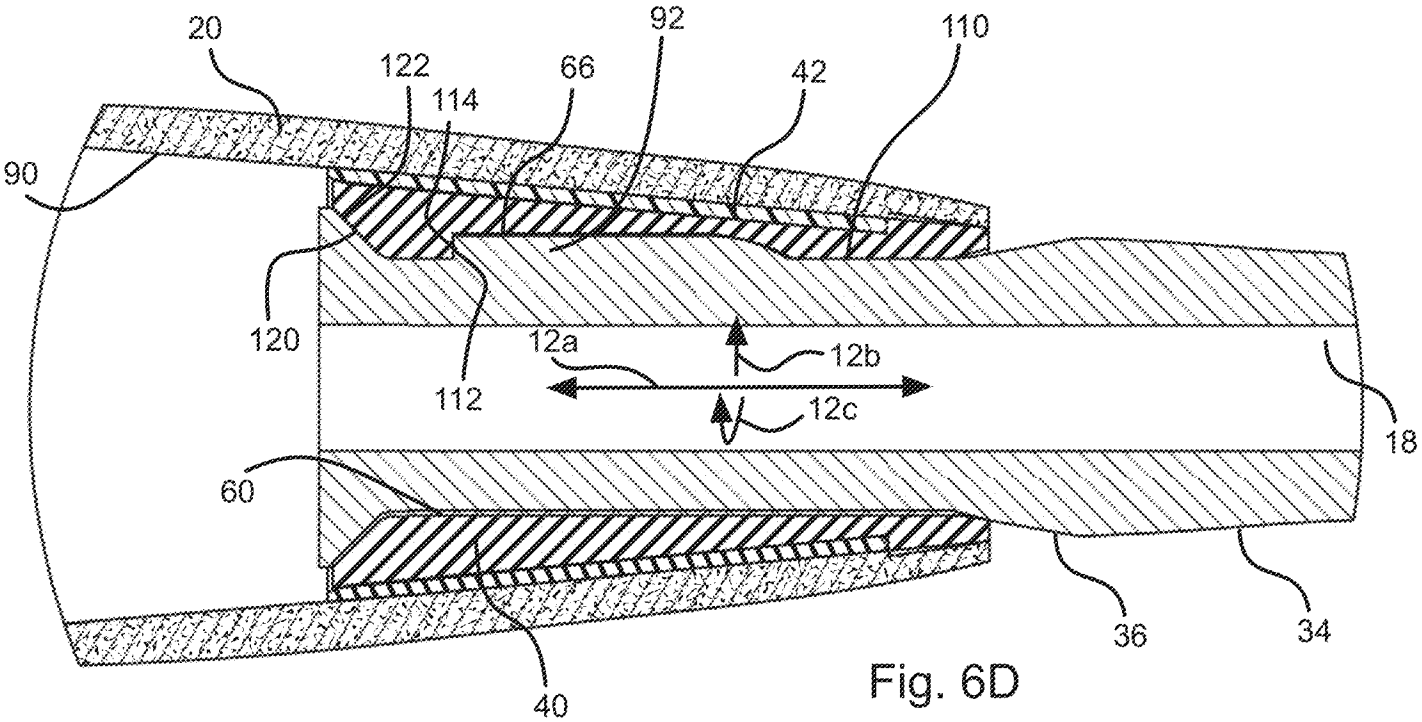
FIG. 6D is a cross-sectional view of a ball bat incorporating the rigid sleeve and a fourth embodiment of the elastomeric coupler in accordance with an embodiment of the present invention.

FIGS. 6B, 6C, and 6D illustrate various alternative embodiments for implementing a vibration damper for a bat 10. The embodiments of 6B, 6C, and 6D may be understood as having some or all of the same features (e.g., all listed features, ranges, and alternative features) as for the embodiment of FIGS. 2 to 6A except as noted in the description below.

Referring specifically to FIG. 6B, in some embodiments, the flared distal portion 30 may be secured to a handle portion 18 that is exclusively cylindrical. For example, the flared distal portion 30 may be formed on a sleeve 100 that secures to the cylindrical handle portion 18 by means of adhesive, co-curing, or other fastening means. Accordingly, the sleeve 100 may define a cylindrical inner surface for conforming to the handle portion 18 and a frustoconical outer surface having some or all of the attributes described above with respect to the flared distal portion 30. The sleeve 100 may be formed of any of the materials listed above as being suitable for forming the handle portion 18. The sleeve 100 may be formed of the same or different type of material as is used to form the handle portion 18. Where the sleeve 100 is used, the asymmetric bulge 92 may be formed on the sleeve 100 or omitted.

Referring to FIG. 6C, in some embodiments, the flared distal portion is omitted and the elastomeric coupler 40 secured directly to a cylindrical outer surface 110 of the handle portion 18. In the embodiment of FIG. 6C, the tapered portion 36 and flared proximal portion 34 are retained. However, in other embodiments the handle portion 18 is exclusively cylindrical as shown in FIG. 6B. In the illustrated embodiment, the inner surface 60 of the elastomeric coupler 40 may also be cylindrical. When undeformed, the inner surface 60 may have a smaller diameter than the cylindrical outer surface 110 such that stretching of the elastomeric coupler 40 is required to place the elastomeric coupler over the handle portion 18. The thickness of the elastomeric coupler 40 at the distal end thereof is greater in the embodiment of FIG. 6B and may provide a higher amount of damping relative to other embodiments disclosed herein.

In some embodiments, resistance to slipping of the handle portion 18 within the elastomeric coupler 40 may be improved by forming a substantially flat axial surface 112 on the asymmetric bulge 92 that engages a corresponding substantially flat axial surface 114 on the elastomeric coupler 40, such as part of the cavity 66. "Substantially flat" may be understood as having all points within 0.5 mm of a plane parallel to the radial direction 12*b* and perpendicular to the longitudinal direction 12*a*. Substantially flat may also be defined as being within 0.5 mm of a cone with a cone angle greater than 80 and less than 90 degrees (90-degree cone angle being a flat plane).

The embodiment of FIG. 6D may be modified relative to the embodiment of FIG. 6C. In particular, a flared distal portion 120 is formed on the handle portion 18 between the distal end and the cylindrical outer surface 110. The cone angle of the flared distal portion 120 may be between 30 and 55 degrees, such as 45 degrees. The flared distal portion 120 may be formed on a separate member that is secured over a distal portion of the cylindrical outer surface 110 by means of adhesive, threads, co-curing, or other fastening means such that a portion of the cylindrical outer surface 110 remains uncovered by the separate member. The flared distal portion 120 may also be formed on a separate member secured to the handle portion 18 by inserting the separate member within the handle portion 18, which may be hollow. The separate member may be secured within the handle portion 18 by means of adhesive, threads, co-curing, or other fastening means.

The elastomeric coupler 40 may define a beveled surface 122 sized to engage the flared distal portion 120. The beveled surface 122 may have substantially (e.g., within 3 degrees of) the same cone angle as the flared distal portion 120.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A ball bat comprising:

a barrel portion having a substantially cylindrical outer surface;

a transition portion connected to the barrel portion having an end portion with an inner surface;

a handle portion having a distal portion positioned within the transition portion;

an elastomeric coupler secured around the distal portion and having an inner frustoconical surface, a first outer frustoconical surface located at a first end thereof, a second outer frustoconical surface located at a second end thereof and abutting the inner surface of the end portion of the transition portion, and a transition extending inwardly from the second outer frustoconical surface to the first outer frustoconical surface; and a rigid sleeve defining an inner surface having a proximal edge, the rigid sleeve secured around the elastomeric coupler interposed between the transition portion and the elastomeric coupler and having the inner surface contacting and compressing the first outer frustoconical surface and the proximal edge abutting the transition.

2. The ball bat of claim 1, wherein the distal portion is flared.

3. The ball bat of claim 2, wherein:

the elastomeric coupler further defines one or more ridges extending outwardly from the outer frustoconical surface; and the rigid sleeve defines a sleeve frustoconical surface and one or more grooves extending outwardly from the sleeve frustoconical surface, the one or more ridges being positioned within the one or more grooves.

4. The ball bat of claim 2, wherein:

the inner frustoconical surface further defines one or more grooves extending outwardly from the inner frustoconical surface; and an adhesive is positioned between the elastomeric coupler and the distal portion, the adhesive at least partially filling the one or more grooves.

5. The ball bat of claim 2, wherein the inner frustoconical surface has a smaller cone angle than the outer frustoconical surface.

6. The ball bat of claim 1, wherein the elastomeric coupler defines an inner surface contacting the distal portion, the distal portion being larger than an undeformed size of the inner surface.

7. The ball bat of claim 1, wherein the elastomeric coupler comprises a material having a hardness less than 95 Shore A.

8. The ball bat of claim 7, wherein the transition portion connects to the handle portion exclusively through the elastomeric coupler.

9. The ball bat of claim 7, wherein any connection between the transition portion and the handle portion includes a member having a hardness of less than 95 Shore A.

10. The ball bat of claim 7, wherein the rigid sleeve comprises a material that has a higher hardness than the elastomeric coupler.

11. The ball bat of claim 7, wherein the rigid sleeve has a hardness of at least 20 Shore D.

12. The ball bat of claim 7, wherein the elastomeric coupler has a hardness between 40 and 95 Shore A and the rigid sleeve has a hardness between 20 and 90 Shore D.

13. The ball bat of claim 1, wherein the distal portion defines an asymmetric bulge.

14. The ball bat of claim 13, wherein the elastomeric coupler defines a cavity sized to receive the asymmetric bulge.

15. The ball bat of claim 1, wherein the distal portion is cylindrical.

16. A method for manufacturing a ball bat comprising:

(a) positioning an elastomeric coupler around a handle portion and sliding the elastomeric coupler from a proximal end of a handle portion to a distal portion of the handle portion such that the elastomeric coupler is stretched outwardly to fit over the distal portion;

(b), following (a), passing a rigid sleeve from the proximal end of the handle portion to the distal portion such that the rigid sleeve is positioned around the elastomeric coupler and compresses the elastomeric coupler; and (c), following (b), positioning a barrel and tapered transition portion around the handle portion and sliding the barrel and tapered transition portion to the distal portion such that the rigid sleeve nests within the tapered transition portion with the barrel extending distally of the handle portion;

wherein the rigid sleeve has higher hardness than the elastomeric coupler.

17. The method of claim 16, further comprising applying adhesive between the elastomeric coupler and the distal portion and applying adhesive between the rigid sleeve and the tapered transition portion.

18. The method of claim 16, wherein the elastomeric coupler has a hardness of less than 95 Shore A and the rigid sleeve has a hardness of more than 20 Shore D.

19. The method of claim 16, wherein:

the elastomeric coupler defines outwardly extending ridges;

the rigid sleeve defines grooves extending outwardly from an interior surface of the rigid sleeve; and the method further comprises inserting the outwardly extending ridges within the grooves.

20. The method of claim 16, wherein following (c) no connection between the tapered transition portion and the handle portion exists that that is not through the elastomeric coupler.

21. A ball bat comprising:

a barrel portion having a substantially cylindrical outer surface;

a transition portion connected to the barrel portion;

a handle portion having a distal portion positioned within the transition portion;

an elastomeric coupler secured around the distal portion and having an inner frustoconical surface, a first outer frustoconical surface, a second outer frustoconical surface, and a transition extending inwardly from the second outer frustoconical surface to the first outer frustoconical surface; and a rigid sleeve defining an inner surface having a proximal edge, the rigid sleeve secured around a majority of the elastomeric coupler, the rigid sleeve being interposed between the transition portion of the barrel and the elastomeric coupler and having the inner surface contacting and compressing the first outer frustoconical surface, the proximal edge of the rigid sleeve abutting the transition, the elastomeric coupler isolating the rigid sleeve from the handle portion, the rigid sleeve not directly contacting the handle portion.

* * * * *